United States Patent [19]

Wasserman

[11] 4,126,252

[45] Nov. 21, 1978

[54] FOLDABLE GARMENT SUPPORT FRAME

[76] Inventor: Arnold S. Wasserman, 826 Cheltenham, Santa Barbara, Calif. 93105

[21] Appl. No.: 806,436

[22] Filed: Jun. 14, 1977

[51] Int. Cl.[2] ..... A47J 51/097; A47J 51/10

[52] U.S. Cl. ..... 223/87; 223/88; 223/94

[58] Field of Search ..... 223/94, 89, 85, 71, 223/83, 84, 72, 87, 88

[56] References Cited

U.S. PATENT DOCUMENTS

| | | | |
|---|---|---|---|
| 1,951,985 | 3/1934 | Likly | 223/71 X |
| 3,043,423 | 7/1962 | Shenker | 223/85 X |

FOREIGN PATENT DOCUMENTS

| | | | |
|---|---|---|---|
| 444,869 | 8/1935 | United Kingdom | 223/71 |
| 1,179,991 | 2/1970 | United Kingdom | 223/71 |

*Primary Examiner*—George H. Krizmanich

[57] ABSTRACT

A garment frame for folding garments, such as suit jackets and trousers, to be packed into a suitcase, comprising a body formed by a plurality of thin and flat panels hinged together, to which a pair of elongated elasticized arms are attached. A suit jacket is draped over the body, which fills and lightly stretches the jacket when its breast buttons are buttoned, and the arms are inserted through the jacket sleeves, crisscross the body, and then are fastened thereto. Additional garments, such as trousers, may be hung on the body inside the jacket. Each panel may be folded into face-to-face relation with an adjoining panel, the arms being stretched around the outside of the folded body.

34 Claims, 6 Drawing Figures

FOLDABLE GARMENT SUPPORT FRAME

BACKGROUND OF THE INVENTION

This invention relates generally to foldable garment support frames and, more particularly, to a new and improved foldable garment support frame which firmly supports and maintains garments in a lightly stretched condition to minimize wrinkling that otherwise results from folding and packing such garments in luggage.

Folding garment fixtures are known which are adapted to aid the traveler in folding and maintaining garments in a neat and relatively wrinkle-free condition. Such garment frames are most useful for packing jackets, trousers and related clothing accessories into the limited confines of a suitcase. These garment frames are intended to inhibit a substantial amount of the wrinkling which otherwise would form in garments that have been folded tightly in a suitcase for long hours.

One known variety of foldable garment fixture comprises a conventional coat-and-trouser hanger suspended from an anchor point on a loop frame formed of metal rod, the frame including a swingable folding bar. To use such a fixture, the garment, typically a jacket and trousers, is arranged on the hanger and suspended from the anchor point. The folding bar is swung into place, laterally disposed across the garment about midway along its length. The garment is then folded around the folding bar back onto itself, being careful that the garment, and particularly any jacket sleeves, are neatly arranged to avoid wrinkling. Such a fixture is usually designed for use with a relatively large suitcase.

In a variation of the foregoing garment fixture, the garment may be folded about a second laterally disposed folding bar, with the result that the garment is folded approximately in thirds for packing in smaller suitcases, sometimes denoted "overnight" cases.

In using either of these foldable garment fixtures, it will be noted that care must be taken to maintain the garments in neat order when folding the assembly. Further, it is apparent that firm support is not provided over the major portion of the garment area which is spanned between the hanger and the folding bar or bars. In other words, the garment is still susceptible to being crushed or wrinkled by other objects which are likely to be placed next to or on top of the garment in packing because the garment is not backed by a firm, flat structure. One solution to this problem is to not pack such objects in the same luggage compartment with the subject garment, but this can result in a substantial waste of space.

Additionally, with these known foldable garment fixtures, there are no special means provided for maintaining the garment relatively tautly wrapped about the folding bars. If the garment should slip or loosen on the fixture, it is more likely to be wrinkled. On the other hand, a garment which is maintained in a lightly stretched condition is less subject to wrinkling.

Accordingly, a need is recognized for a foldable garment support frame which can be used easily for folding and packing garments, will firmly support the entire area of the garment and is effective to maintain the garment in a lightly stretched condition on the frame. The present invention clearly fulfills this need.

SUMMARY OF THE INVENTION

The present invention resides in a foldable garment support frame which provides firm and flat support over substantially the entire garment, is effective to maintain the garment in a lightly stretched condition when folded, and on which garments can be easily and quickly arranged.

Briefly, and in general terms, the garment support frame comprises a body formed by at least two thin and flat panels, an uppermost and a lowermost panel, disposed in substantially coplanar relationship with one another and joined together along adjacent edges by hinged connections, a pair of elongated flexible arms having one end attached to the uppermost panel of the body and opposite free ends receivable through garment sleeves, and fastening means for releasably securing these free ends to the lowermost panel of the body. Each of the plurality of panels is sized to fold onto an adjoining panel and the uppermost panel is adapted to conformably support the shoulder portions of an appropriate jacket-like garment. It will be recognized that the present invention is especially adapted for folding garments such as suit jackets and the like, along with related clothing items, although it will be apparent that its uses are not so limited.

More particularly, and in the presently preferred embodiment, the arms attach to the uppermost panel along side edges thereof and diagonally crisscross the body to fasten near opposite sides of the lowermost panel. Further, the arms are endowed with longitudinal elasticity and wrap about the outside of the body when folded whereby the garment sleeves are longitudinally stretched. Garments which are lightly stretched are less subject to formation of wrinkles.

In addition, although the panels are substantially rigid, they have limited flexibility and at least an intermediate portion of the body is substantially the same lateral size as the shoulder portion of the uppermost panel, so that the body tends to fill the inside of a jacket-like garment. As a result, when the breast buttons on the garment are buttoned, it will be lightly stretched laterally by the panels. From the foregoing, it can be seen that the garment therefore is stretched both laterally and longitudinally by the frame to minimize formation of wrinkles.

Another feature of the present invention exists in the hinged connections between adjoining panels. Each hinged connection is relatively wide whereby space is provided between the folded adjoining panels for the garments, to avoid crimping them.

Additional features incorporated in the presently preferred embodiment include provision of an aperture in at least one of the panels to define a laterally extending edge for draping additional garments, such as trousers and neckties, on the body. Also, the uppermost panel can carry hanger means for suspending the body from an appropriate garment rack. The hanger means comprises a hook which can be retracted by pivoting it down against the uppermost panel in the preferred embodiment described hereinbelow.

It will be appreciated from the foregoing that the present invention represents a significant advance in foldable garment support frames. In particular, an entire garment is firmly supported by and effectively maintained in a lightly stretched condition on the frame to inhibit formation of wrinkles. Other aspects and advantages of the invention appear above or will become apparent from the following more detailed description, taken in conjunction with the accompanying drawing.

DETAILED DESCRIPTION

Figure 1:
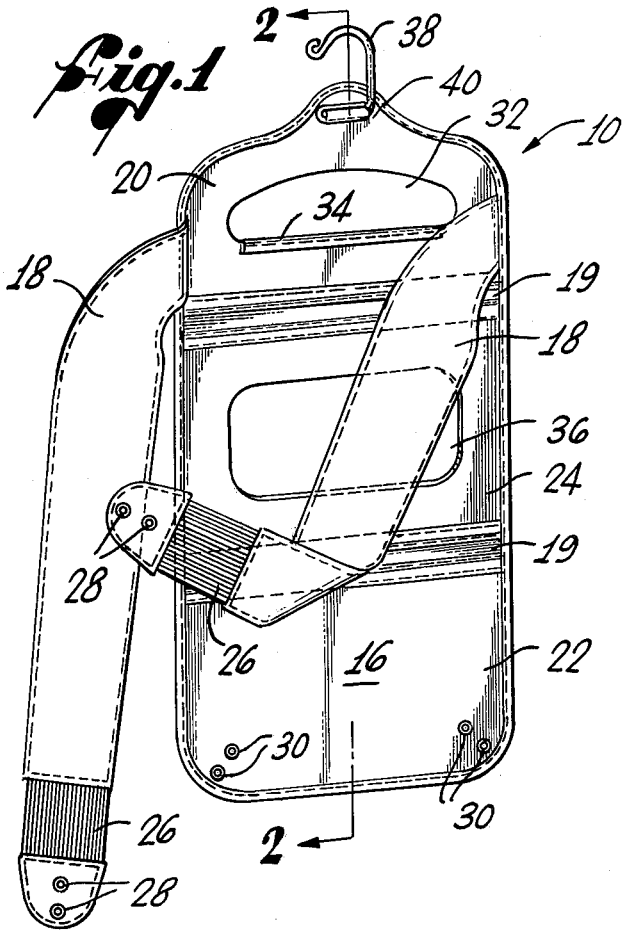
FIG. 1 is a perspective view of a foldable garment support frame embodying the novel features of the present invention, showing one of the flexible arms draped across the body of the frame.

As shown in the drawing for purposes of illustration, the invention is a foldable garment support frame, indicated generally by the reference numeral 10, for firmly supporting and maintaining garments, such as the suit jacket 12 and trousers 14 shown (FIGS. 1, 3, 4 and 6), in a lightly stretched condition when folded for packing or storage in luggage. The frame 10 comprises a body 16, which is sized and shaped to fill the trunk portion of the jacket 12, and a pair of flexible arms 18, which are receivable through the sleeves of the jacket. The arms 18 have sufficient length to extend beyond the open ends of the jacket sleeves and thereafter fasten to the body 10 in a manner to be described below.

The body 10 illustrated in the drawing, comprises three thin and flat panels, an uppermost panel 20, a lowermost panel 22 and a central panel 24 therebetween, vertically aligned in substantially coplanar relationship to one another and joined together along adjacent lateral edges by hinged connections 19. The panels are generally rectangular in shape, except that the uppermost panel 20 is shaped along its upper edge to conformably support the shoulder area of the jacket 12. Both the uppermost panel 20 and the lowermost panel 22 are sized to fold one on top of the other onto the central panel 24. Once folded, the lengthwise dimension of the body 16 is reduced to approximately one-third of its unfolded length.

Although the body 16 is shown with three hinged panels, it will be appreciated that it can be formed of two such panels, an upper and a lower panel, whereby the body would be reduced to one-half of its unfolded length after being folded. Of course, in that case, the frame 10 would be adapted for packing in a larger suitcase than in the case of the illustrated embodiment. The choice of the number of panels depends on the desired size of the folded frame, limited by the practical consideration of the number of times a garment can or should be folded.

Each of the panels illustrated is formed of a lightweight plastic material which has substantial rigidity, yet limited flexibility. The central panel 24 is the same lateral size as the uppermost panel 20, whereby the body tends to fill the entire trunk portion of the jacket 12 so that once such a garment is arranged on the body 16 and one or more breast buttons are buttoned (FIGS. 3 and 4), the body will exert a light lateral stretching force on the jacket. The limited flexibility in the panels produces a light outward spring-action against the interior of the trunk portion of the jacket 12. This light stretching tends to inhibit formation of wrinkles.

Further, since the panels have substantial rigidity, garments arranged on the body 16 are firmly supported over their entire area. This feature enables packing the folded garments in a suitcase among other objects without significant danger of crushing or wrinkling such garments. It will also be noted that the body 16 has a strip of flexible material, such as vinyl, sewn along the panel edges forming its outer perimeter to protect the lining of the jacket 12.

Figure 4:
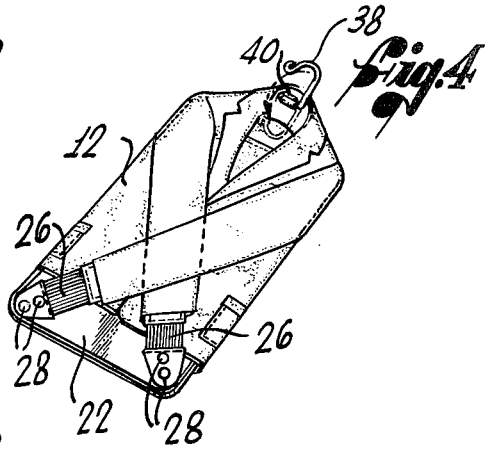
FIG. 4 is a further reduced view similar to FIG. 3 but showing the garments secured on the frame just prior to folding thereof.

The arms 18 are flat and laterally sized to substantially fill a jacket sleeve in a flattened condition. Each arm 18 is sufficiently long to extend beyond the open ends of the sleeve. The material forming the arm 18 is a lightweight, but durable vinyl material with an elastic panel 26 sewn therein. The arms 18 are attached to opposite side edges of the uppermost panel 20 and have snap fasteners 28 affixed to their opposite free ends. These snap fasteners 28 cooperate with mating fasteners 30 located on the lowermost panel 22 whereby the free ends of the arms 18 can be releasably fastened thereto. Preferably, the fasteners 28 and 30 are disposed so that the arms diagonally crisscross the body 16 when fastened to the lowermost panel 22 (FIG. 4). This configuration of the jacket sleeves is desirable to make them lie flat and wrinkle-free against the body 16.

Figure 5:
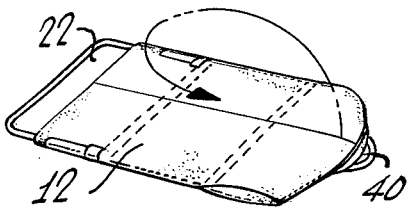
FIG. 5 is a further reduced view similar to FIG. 4 but showing the garment and frame assemblage lying face down, about to be folded.
Figure 6:
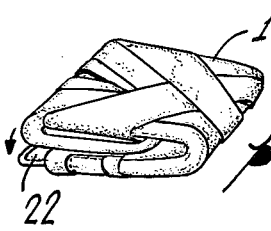
FIG. 6 is yet a further reduced perspective view showing the garment and frame assemblage in a folded condition, ready for packing.

The elastic panels 26 are provided in the arms 18 to pull the jacket sleeves relatively taut longitudinally when the body 16 is folded. This longitudinal stretching of the jacket sleeves further tends to inhibit formation of wrinkles while the garments are folded and secures the trunk portion of the jacket in place on the body 16. To achieve this result, of course, the body 16 is folded by folding the uppermost panel over toward the back, onto the central panel 24 (FIG. 5), with the arms 18 on the outside of the hinged connection 19 therebetween. The uppermost panel 20 and the central panel 24 then are folded as a unit back onto the lowermost panel 22, with the arms 18 stretched relatively taut around the outside of the folded body 16 (FIG. 6).

Referring again to FIGS. 1 and 3, additional garments, such as vests, neckties and the illustrated trousers 14, can be arranged on the frame 10 due to provision of a laterally-extending oblong aperture 32 in the uppermost panel 20. The lower edge 34 of the aperture 32 defines a support surface over which garments may be hung, inside the jacket 12. The support edge 34 preferably is padded to protect the garments and to provide a relatively wide rounded bar which avoids creasing the garments. A secondary aperture 36 is provided in the central panel 24 to allow the user of the frame to work through the body 16 when arranging garments within the aperture 32 in the uppermost panel 20.

Figure 2:
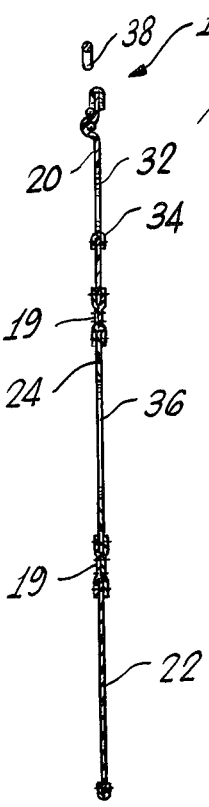
FIG. 2 is a cross-sectional view taken along line 2—2 of FIG. 1.

The hinged connections 19 are illustrated most clearly in FIG. 2. To provide room between adjoining folded panels for multiple layers of garment fabrics, each hinged connection 19 is relatively wide. In the presently preferred embodiment, these spaced hinged connections 19 are achieved by forming them with relatively wide strips of flexible material sewn to adjoined panels. Hence, the adjacent edges of the adjoined panels do not actually abut one another, but are spaced a short distance apart by the hinge strips. The space between folded panels which is provided by the hinge strips can be selected to accommodate the numbers of garment layers intended to be arranged on the frame 10.

The body 16 is further provided with hanger means by which the frame can be suspended from an appropriate garment rack. As seen in FIG. 1, the hanger means can comprise a hook 38 formed out of metal rod and attached to a neck area 40 along the upper border of the uppermost panel 20. A lateral channel is formed in the uppermost panel 20 by making a pair of laterally spaced vertical cuts therein and deforming the panel portion located between the cuts out of the panel plane. The hook 38 is bent to be inserted through this channel and back onto itself whereby it is loosely journalled to be swung or pivoted between extended and retracted positions. When pivoted down onto the uppermost panel 20 (FIG. 4), the hook 38 is in the retracted position so as not to protrude from the folded garment frame 10.

Figure 3:
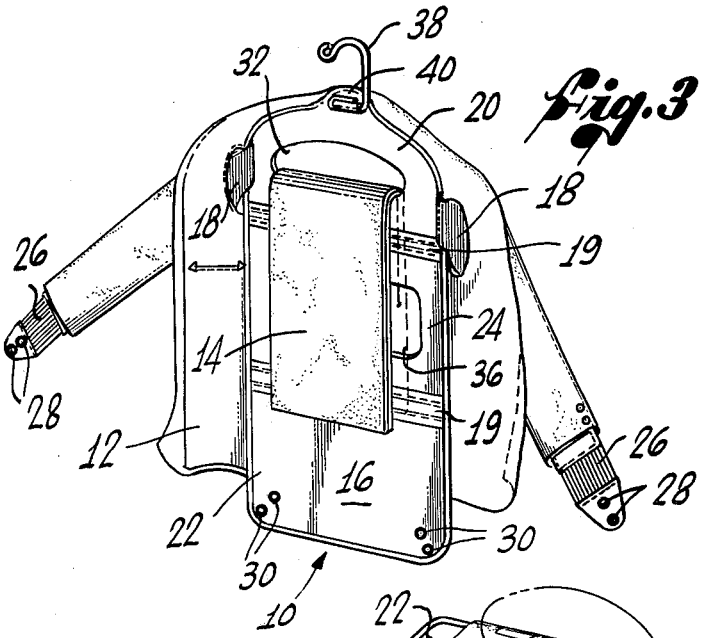
FIG. 3 is a reduced perspective view showing representative garments in the process of being arranged on the frame.

From the foregoing description, the manner in which the garment frame is used will be readily understood. The unfolded frame 10 can be suspended by hook 38 from a garment rack and a number of pairs of trousers, ties and other clothing accessories may be hung through the aperture 32 in the uppermost panel 20. A jacket-like garment, as well as one or more vests, are then dressed over the body 16 by draping such garments over the shoulder areas of the uppermost panel 20 and inserting the arms 18 entirely through the garment sleeves (FIG. 3). One or more breast buttons on the jacket-like garment are buttoned to laterally stretch it on the body 16 and the free ends of the arms 18 are fastened in crisscross fashion to the lowermost panel 22 (FIG. 4). The frame 10 then can be laid face down on a horizontal surface with the hanger 38 retracted (FIG. 5). The uppermost panel 20 is then folded back onto the central panel 24, and these two panels are in turn folded as a unit onto the lowermost panel 22, with the arms 18 relatively tautly wrapped about the outside of the folded body 16 (FIG. 6). The folded frame can then be packed in suitable luggage, the garments being firmly supported and maintained in a lightly stretched condition to inhibit formation of wrinkles.

From the foregoing, it will be evident that the present invention provides a novel, simple and effective foldable garment support frame which is well adapted to inhibit formation of wrinkles in garments folded for packing in luggage. It will also be evident that, while a specific presently preferred embodiment has been illustrated and described, various modifications and changes may be made within the spirit and scope of the invention.

I claim:

1. A foldable garment support frame comprising:

a body comprising a plurality of vertically aligned panels disposed in substantially coplanar relationship with one another, said body having at least an uppermost panel and a lowermost panel, said uppermost panel including a shoulder portion adapted to conformably support the shoulder portions of a jacket-like garment;

hinged connection means for joining adjacent panels together and enabling said adjacent panels to fold together in face-to-face relationship;

a pair of elongated arms each having one end attached to said uppermost panel and an opposite free end adapted for insertion through a sleeve on said jacket-like garment; and fastening means for releasably securing said free ends of said arms to said lowermost panel.

2. A garment support frame as defined in claim 1, wherein:

said panels are thin and flat and are formed of a substantially rigid material having limited flexibility, at least an intermediate portion of said body being substantially the same lateral size as said shoulder portion of said uppermost panel.

3. A garment support frame as defined in claim 1, wherein:

said arms are attached to said uppermost panel near opposite side edges thereof, said arms being adapted to diagonally crisscross said body to fasten near opposite side edges of said lowermost panel.

4. A garment support frame as defined in claim 3, wherein:

said arms are formed of thin and flexible materials;

and further including elastic means carried by said arms for longitudinally stretching the sleeves of said jacket-like garment when said body is folded.

5. A garment support frame as defined in claim 1, wherein:

said hinged connection means provides a space between adjacent folded panels, said space being sufficient to maintain portions of said jacket-like garment therein.

6. A garment support frame as defined in claim 1, and further including:

support means on at least one of said panels for placing further garments on said body.

7. A garment support frame as defined in claim 6, wherein:

said support means comprises an aperture formed in at least one of said panels, said aperture defining a supporting edge to support said further garments.

8. A garment support frame as defined in claim 6, wherein:

said hinged connection means provides a space between adjacent folded panels, said space being sufficient to maintain portions of said jacket-like garment and said further garments therein.

9. A garment support frame as defined in claim 1, and further including:

hanger means for suspending said body from a cooperating garment rack.

10. A garment support frame as defined in claim 9, wherein:

said hanger means is selectively movable between extended and retracted positions relative to said body.

11. A foldable garment support frame comprising: three thin and flat panels comprising an uppermost panel, a lowermost panel and a central panel disposed therebetween, said panels disposed in substantially coplanar relationship with one another and having adjacent lateral edges joined together by hinged connections, said uppermost panel shaped along an edge opposite said central panel to conformably support the shoulders of a jacket-like garment, and said uppermost panel and said lowermost panel sized to fold one on top of the other onto said central panel;

a pair of elongated flexible arms each having one end attached to said uppermost panel and an opposite free end adapted for insertion through the sleeves of said garment, said free ends further adapted to extend beyond the open ends of said sleeves; and fastening means for releasably securing said free ends of said arms to said lowermost panel.

12. A garment support frame as defined in claim 11, wherein:

each of said panels is formed of a substantially rigid material having limited flexibility, at least a portion of said central panel being substantially the same lateral size as said uppermost panel.

13. A garment support frame as defined in claim 11, wherein:

said arms are attached to said uppermost panel near opposite side edges thereof and said arms are adapted to diagonally crisscross said body to fasten near opposite side edges on said lowermost panel.

14. A garment support frame as defined in claim 13, wherein:

said arms carry elastic means thereon for longitudinally stretching the sleeves of said garment when said body is folded.

15. A garment support frame as defined in claim 11, wherein:

each of said hinged connections is relatively wide to provide a space between folded adjoining panels to maintain portions of said jacket-like garment herein.

16. A garment support frame as defined in claim 15, wherein:

each of said hinged connections is formed by joining adjacent panels with a narrow strip of flexible material, the adjacent edges of said panels being spaced apart to provide said space between adjoining folded panels.

17. A garment support frame as defined in claim 11, and further including:

support means on at least one of said panels for supporting further garments on said body.

18. A garment support frame as defined in claim 17, wherein:

said support means comprises an aperture formed in at least one of said panels, said aperture defining a supporting edge to support said further garments.

19. A garment support frame as defined in claim 18, wherein:

each of said hinged connections is formed by joining adjacent panels with a narrow strip of flexible material, the adjacent edges of said panels being spaced apart to provide a sufficient space therebetween when said body is folded for portions of said jacket-like garment and said further garments.

20. A garment support frame as defined in claim 11, and further including:

hanger means for suspending said body from a cooperating garment rack.

21. A garment support frame as defined in claim 20, wherein:

said hanger means comprises a hook mounted to said uppermost panel, said hook being selectively movable between extended and retracted positions.

22. A foldable garment support frame comprising:

a pair of thin and flat panels comprising an uppermost and a lowermost panel disposed in substantially coplanar relationship with one another and having adjacent edges joined together by hinged connections, said uppermost panel shaped along an edge opposite said lowermost panel to conformably support the shoulders of a jacket-like garment, and said uppermost panel and said lowermost panel adapted to fold into face-to-face relationship;

a pair of elongated flexible arms each having one end attached to said uppermost panel and an opposite free end adapted for insertion through the sleeves of said garment, said free ends further adapted to extend beyond the open ends of said sleeves; and fastening means for releasably securing said free ends of said arms to said lowermost panel.

23. A garment support frame as defined in claim 22, wherein:

both said panels are formed of a substantially rigid material having limited flexibility, both said panels further being of substantially the same lateral size.

24. A garment support frame as defined in claim 22, wherein:

said arms are attached to said uppermost panel near opposite side edges thereof and said arms are adapted to diagonally crisscross said body to fasten near opposite side edges on said lowermost panel.

25. A garment support frame as defined in claim 24, wherein:

said arms carry elastic means thereon for longitudinally stretching the sleeves of said garment when said body is folded.

26. A garment support frame as defined in claim 22, wherein:

said hinged connection is relatively wide to provide a space between said panels when said body is folded to maintain portions of said garment therein.

27. A garment support frame as defined in claim 26, wherein:

said hinged connection is formed by joining said panels with a narrow strip of flexible material, the adjacent edges of said panels being spaced apart to provide said space between adjoining folded panels.

28. A garment support frame as defined in claim 22, and further including:

support means on at least one of said panels for supporting further garments on said body.

29. A garment support frame as defined in claim 28, wherein:

said support means comprises an aperture formed in at least one of said panels, said aperture defining a supporting edge to support said further garments.

30. A garment support frame as defined in claim 29, wherein:

said hinged connection is formed by joining said panels with a narrow strip of flexible material, the adjacent edges of said panels being spaced apart to provide a sufficient space ebetween adjoining folded panels to maintain portions of said jacket-like garment and said further garments therebetween.

31. A garment support frame as defined in claim 22, and further including:

hanger means for suspending said body from a cooperating garment rack.

32. A garment support frame as defined in claim 31, wherein:

said hanger means comprises a hook mounted to said uppermost panel, said hook being selectively movable between extended and retracted positions.

33. A foldable garment support frame comprising:

a body comprising a plurality of vertically aligned thin and flat panels disposed in substantially coplanar relationship with one another, said body having at least an uppermost panel and a lowermost panel;

said uppermost panel including a shoulder portion adapted to conformably support the shoulder portions of a jacket-like garment;

hinged connection means for joining adjacent panels together and enabling said adjacent panels to fold together in face-to-face relationship;

a pair of elongated flexible arms each having one end attached to said uppermost panel near opposite side edges thereof and an opposite free end adapted for insertion through a sleeve on said jacket-like garment;

fastening means for releasably securing said free ends of said arms to said lowermost panel, said arms being adapted to diagonally crisscross said body to fasten near opposite side edges of said lowermost panel;

elastic means carried by said arms for longitudinally stretching the sleeves of said jacket-like garment when said body is folded; and said panels being formed of a substantially rigid material having limited flexibility, at least an intermediate portion of said body being substantially the same lateral size as said shoulder portion of said uppermost panel.

34. A foldable garment support frame as defined in claim 33, further including:

support means on at least one of said panels for placing further garments on said body; and wherein said hinged connection means provides a space between adjacent folded panels, said space being sufficient to maintain portions of said jacket-like garment and said further garments therein.

* * * * *